United States Patent [19]

Shuffstall

[11] 4,221,404

[45] Sep. 9, 1980

[54] MEDICAL HISTORY RECORD FILING SYSTEM

[76] Inventor: Richard M. Shuffstall, Kirkwood Place, Rudolph, Wis. 54475

[21] Appl. No.: 914,843

[22] Filed: Jun. 12, 1978

[51] Int. Cl.[3] ..... G09F 11/30

[52] U.S. Cl. ..... 283/1 A; 283/1 R; 283/37; 283/48 R; 40/382

[58] Field of Search ..... 40/382, 384; 283/1 R, 283/1 A, 6, 32, 37, 48

[56] References Cited

U.S. PATENT DOCUMENTS

| | | | |
|---|---|---|---|
| 1,203,902 | 11/1916 | Nichols | 40/371 |
| 2,248,162 | 7/1941 | De Araujo | 283/1 A |
| 2,295,952 | 9/1942 | Jones et al. | 40/382 |
| 3,043,734 | 7/1962 | Porter | 156/249 |
| 3,740,081 | 6/1973 | Whipperman | 283/6 |
| 3,755,937 | 9/1973 | Anderson | 40/384 |
| 3,962,807 | 6/1976 | Pantone | 40/360 |

*Primary Examiner*—Paul A. Bell
*Attorney, Agent, or Firm*—Michael W. York

[57] ABSTRACT

A medical history record filing system including a plurality of attachment sheets for holding medical test records and a plurality of medical record sets. Each medical record set includes a plurality of separable portions and at least one of the plurality of separable portions is adapted to be attached to one of the attachment sheets. The record sets and the attachment sheets are color coded to indicate the type of medical test that is to be performed and recorded. The separable portion of the medical records set that is adapted to be attached to the medical record attachment sheet has provisions for locating the separable portion in a chronological order on the medical record attachment sheet. Each medical record set has provisions for the physician to indicate the type of tests that are to be run, the urgency of the request and other pertinent information. In addition, each medical record set has provisions for the laboratory, or the person that is analyzing the tests to record test data. Provisions related to the test desired are separated vertically from the provisions related to the test results. The separable portions of the medical record sets are so designed that when a series of them are attached to the attachment sheet only the test results and related information are normally visible on the medical record attachment sheet. One or more medical record attachment sheets and the associated portions of the medical record set can be located in one file folder.

12 Claims, 10 Drawing Figures

MEDICAL HISTORY RECORD FILING SYSTEM

BACKGROUND OF THE INVENTION

Recent advances in science have made it possible for a physician and the like to employ many types of tests in diagnosing, treating and evaluating various diseases or the health of an individual. These tests are, of course, very valuable to the physician since they enable him to more rapidly determine the status of the health of a patient or to diagnose an illness. However, the wide variety of tests that are available do present a problem for the physician in properly ordering the tests and insuring that the test instructions are sent to the proper destinations. In addition, the multiplicity of tests that are available pose a problem of administering the proper tests at the proper time so that the physician can be assured of obtaining the test results to utilize in his diagnosis and treatment of the patient. In addition, it is difficult to insure that the test results will reach all the necessary destinations so that appropriate records pertaining to these tests can be properly maintained. It is also difficult to insure that the test results are presented in a manner that permits the physician to easily utilize them for diagnostic and other purposes and to readily detect changes in tests over a period of time.

The need for systems and procedures for keeping track of medical tests and the records related thereto has been recognized to some extent in the past and there are a number of U.S. Patents that have been granted on systems or procedures. U.S. Pat. Nos. 3,043,734; 3,755,937; 3,740,081; 3,962,807 all present inventions related to some extent to medical record systems and/or procedures. For instance, U.S. Pat. No. 3,043,734 presents an invention that makes it easier to maintain medical records by providing a folder or carrier sheet that has a portion of one side covered with a special gum stock and a backing or protective covering that is located thereon that may be removed in order to permit a report sheet to be applied to the folder through the use of the adhesive.

A portion of the backing that is left on the adhesive also serves as a guide for lining up sheets that are to be inserted into the folder. U.S. Pat. No. 3,962,807 discloses a system for identifying x-ray film for determining which part of the body or body system was x-rayed through the use of films that are color coded by a color coded label. U.S. Pat. No. 3,740,081 discloses a label and the like that only presents pertinent information to the person that needs that information without revealing extraneous or irrelevant information that is not needed for conducting a test and the like.

In spite of the advances illustrated in the inventions and disclosures mentioned in some of the previously noted patents, a comprehensive system for permitting a physician to readily order needed medical tests, to obtain the tests in a desired time period and to have the test results readily and clearly available for the use by the physician is currently needed. As a consequence, much time is lost in maintaining numerous records, sorting through the records to locate needed information and attempting to find records that have been misplaced or lost.

This invention overcomes the problems associated with the complex task of handling numerous medical tests, test requests and test results and this invention permits physicians to conveniently order the tests, obtain the test results in the time frame that he desires and to have these test results presented in a meaningful way that permits him to readily determine from these tests the status of an individual's health or other pertinent information.

SUMMARY OF THE INVENTION

This invention relates to medical record filing systems, and more particularly to medical history record filing systems for filing the results of medical tests.

It is accordingly an object of the invention to provide a medical history record filing system that readily permits a physician or the like to order medical tests.

It is also an object of the present invention to provide a medical history record filing system that permits records to be easily maintained.

It is also an object of the present invention to provide a medical history record filing system that permits medical history records to be easily filed.

It is also an object of the present invention to provide a medical history record filing system that helps prevent medical history records from being lost or mislaid.

It is also an object of the present invention to provide a medical history record filing system that permits the physician or the like to review medical history test data that is arranged in chronological order.

It is also an object of the present invention to provide a medical history record filing system that permits a physician or the like to review essential medical history information without having to review non-essential information.

It is also an object of the present invention to provide a medical history record filing system that assists in preventing the misfiling of medical test information.

It is also an object of the present invention to provide a medical history record filing system that permits easy dissemination of medical test information to a variety of departments of a hospital or the like that may be interested in this information.

It is also an object of the present invention to provide a medical history record filing system that permits a physician and the like to readily order numerous medical tests.

It is also an object of the present invention to provide a medical history record filing system that permits a physician and the like to readily obtain the results of medical tests as they are needed.

It is also an object of the present invention to provide a medical history record filing system that easily permits a multiplicity of medical record tests to be easily filed so that they are readily available for use.

It is also an object of the present invention to provide a medical history record filing system that permits medical test samples to be easily labeled so that the results of the medical tests on these samples can be readily entered into the medical files.

The present invention provides a medical history record filing system that includes means for holding medical test records, and at least one medical record set that includes a plurality of separable portions. Attachment means are also provided for attaching at least one of the separable portions to the means for holding the medical test records. At least one of the plurality of separable portions are color coded for indicating the type of medical test to be performed and recorded. The medical history record filing system also has provisions for locating a plurality of separable portions from the record sets for covering up non-essential information so that non-essential information does not hinder a person in reviewing this information. The medical history record filing system also has detachable specimen labels for preventing specimens and the results of the tests on the specimens from being mis-recorded or recorded on the improper medical records.

BRIEF DESCRIPTION OF THE INVENTION

The invention will be hereinafter more fully described with reference to the accompanying drawings in which.

DETAILED DESCRIPTION OF THE PREFERRED EMBODIMENTS

The primary mission of a department of laboratories in a hospital or the like is to assist the physician in the delivery of patient health care by providing, upon request, timely and accurate services. This requires a coordinated request and reporting system that is clearly understood and efficiently conducted by all participants. Of major importance to the success of this very formidable communications task are the forms which are used in connection with these efforts.

Multiple part forms which serve the dual role of requests and reports represent, perhaps, the single best format for a manual hospital laboratory communications system. When properly planned and implemented, they serve to minimize handwriting, permit convenient handling, provide succinct and standardized instructions, generate inexpensive copies, and lend efficiencies to their distribution. The forms, obviously, should be of a convenient size in order to be readily accomodated by the usual files or charts that are maintained in the hospital, etc.

Figure 1:
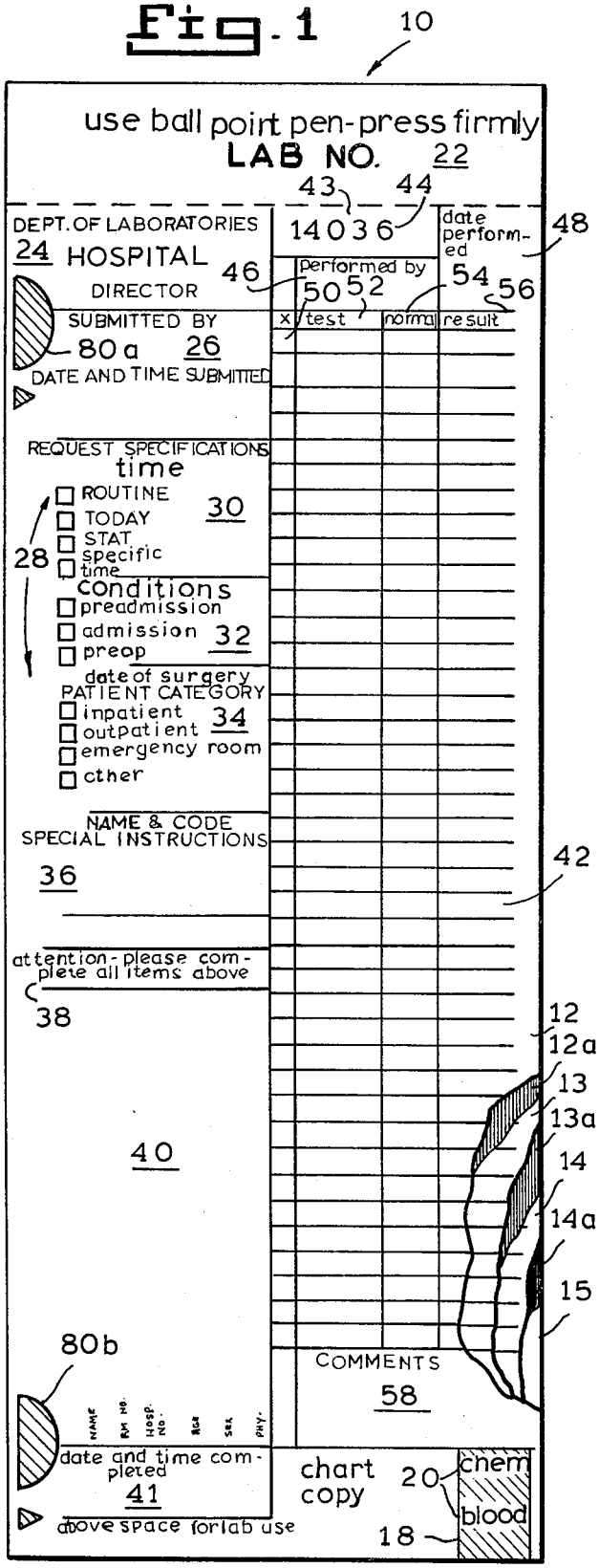
FIG. 1 is a top or plan view of a request/report form set which forms part of the present invention.
Figure 4:
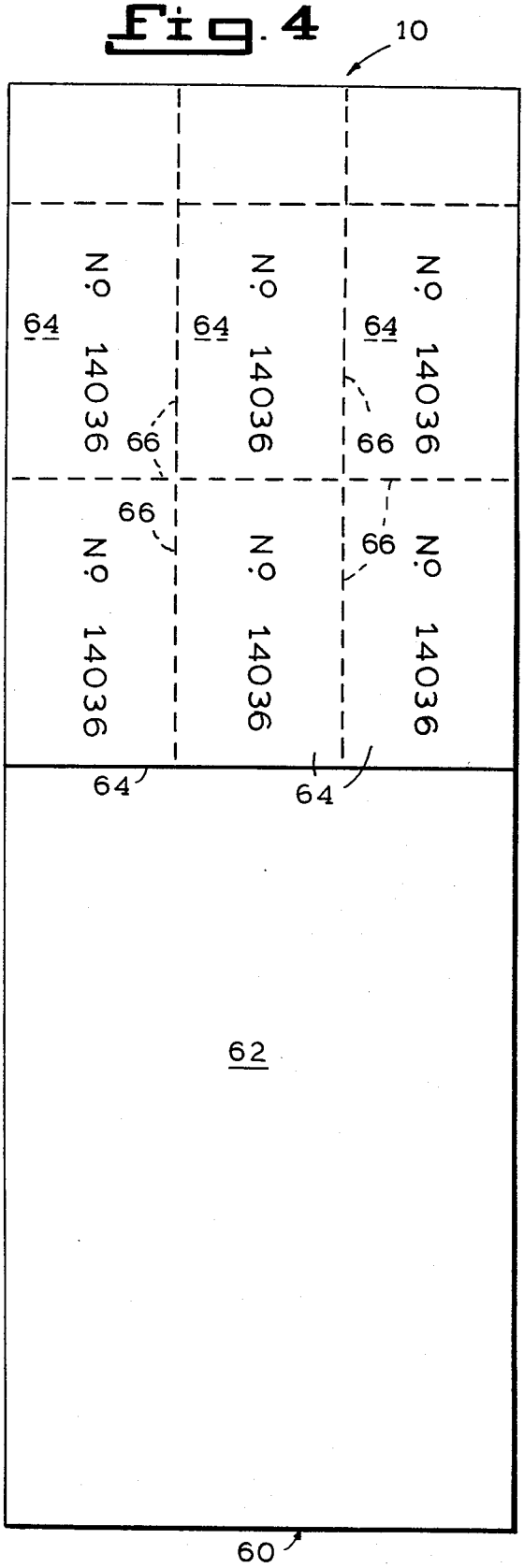
FIG. 4 is a rear or back view of the multilayered request/report form set illustrated in FIG. 1.
Figure 3A:
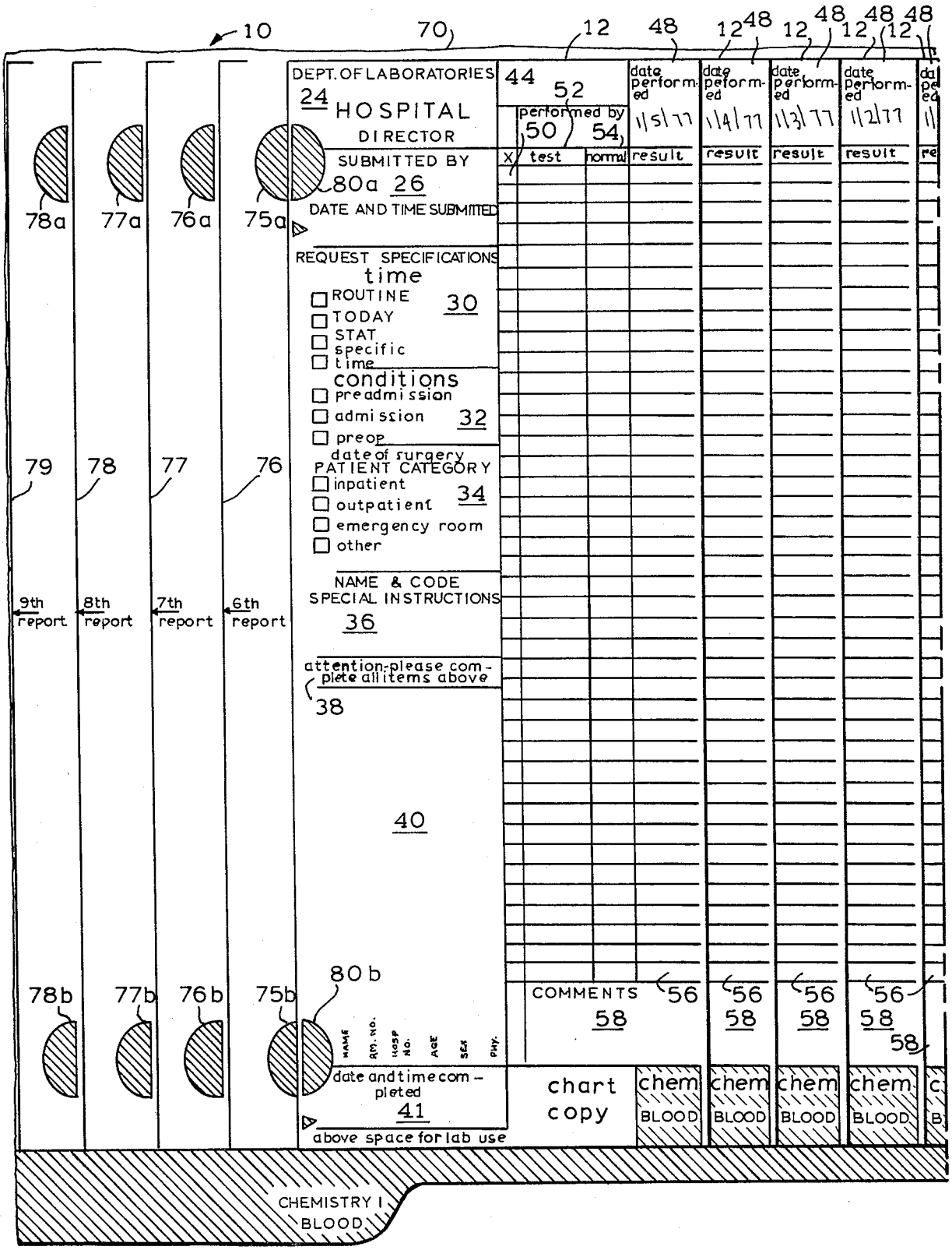
FIG. 3A is a top or plan view of an attachment sheet illustrating how a plurality of portions of the multi-layered request/report form sets are attached to the attachment sheet.

The medical request/report form set which forms part of the present invention is illustrated in FIGS. 1, 3A and 4 and is designated generally by the number 10. As best illustrated in FIG. 1, the medical request/report form set 10 comprises a plurality of separate layers designated respectively by the numbers 12, 13, 14 and 15. These separable portions are designed to be sent to various divisions or locations within a hospital or similar facility to perform various functions as will hereinafter be more fully described.

Located between the separable layers 12, 13, 14 and 15 are respective separable carbon portions **12*a*, 13*a*, and 14*a* which serve the function of transferring all the information that may be indicated on the front portion 12 through the separable carbon portions to the respective separable portions 12, 13, 14 and 15 so that only one portion of the separable portions need to be filled out in order to provide all the information that is necessary in order to completely utilize the medical request/report form set. It will of course be realized that the separable carbon portions designated 12*a*, 13*a* and 14*a* may be eliminated by self-reproducing separable layers 12, 13, and 14** that contain some type of transferrable material located on their back or rear sides that serves to transmit the indentations made on the front side of the separable portions to the respective front or top side of the separable portions located underneath the other separable portion.

As best indicated in FIG. 1, the medical request/report form set 10 is color coded by some designation such as that indicated by the green designation 18 in the lower right hand corner. Located on or near this green color coded portion are the words "CHEM/BLOOD" that are designated by the number 20. This word description 20 is to assist in eliminating confusion and to assist possibly color blind persons in handling these request/report form sets.

The medical request/report form set 10 contains a variety of information that is used in the process of ordering certain laboratory tests, running the tests and reporting results on the same. For the sake of convenience the form is divided vertically substantially in its central portion so that one portion or one half, or substantially one half portion thereof of the form can be used to indicate the type of tests and other required information and the other half or substantially one half portion thereof of the report form can be utilized to report the actual results of the tests. The significance of such a division will be hereinafter more apparent as the use of the invention is described in further detail.

As illustrated in FIG. 1, at the top portion of the request/report form set 10 that is non-separable and is designated by the number 22 instructions are given for the general use of the form 10 which in this instance indicates that a ball point pen should be utilized with heavy pressure. In addition, provision is provided in this portion 22 for providing a lab number in the event there are a number of laboratories that are handling similar type forms. On the left upper portion of the separable portion of the request/report form set 10 is a block designated by the number 24 which is utilized to indicate the hospital, and if necessary by state or other law, to provide a space for the name of the laboratory director. Located immediately below this portion is another portion 26 which indicates the name of the person or parties submitting the laboratory request and also the day and time that it is submitted.

Located below the portion 26 is a section designated generally by the number 28 that provides space for requested specifications that are extremely important or pertinent to the laboratory or other similar-type tests that are to be run. This section or portion 28 contains a block or portion 30 that is utilized to indicate the time in which the specified tests must be run. For instance, it indicates whether they are run on a routine basis, must be available at a specific time or must be available that very day. Located below the block or space 30 is another block or space 32 that is used to indicate the condition or status of the patient. For instance, the patient as indicated in this block could be in a pre-admission status, an admission status, or a pre-operative status. Furthermore, the exact date of surgery in the case of the latter could be indicated.

Located immediately below the condition block or space 30 is a patient category block for indicating the type of patient that the tests will be run on. The patient could be in-patient, out-patient, emergency room patient, or in some other specified category in which case the doctor or other person would fill in that category. Located immediately below the above indicated block or space 34 is another block 36 that provides sufficient area for the doctor or other person filling out the form to indicate any special instructions that are to be carried out in connection with the specific laboratory request associated with this form 10. Instructions are also provided beneath the block 36 that indicate that all of the above items contained in the blocks 24, 26, 28 and 36 should all be completed. These instructions are designated by the number 38.

Located beneath the portion designated by the number 38 is another block or portion 40 which contains spaces for indicating pertinent information concerning the patient or the like upon which the laboratory tests are being run. In this case the patient's name is indicated, his room number, the hospital number, age, sex and physician. Located below the block 40 is another smaller block or portion that is designated by the number 41 and is to be utilized to indicate the date and the time that the tests that are requested to be run have been completed.

Located on the right hand or other half or substantially half portion of the medical request/report form set 10 is a laboratory or tests results portion space or section designated generally by the number 42. Located in the upper portion of this section 42 is a block or space 43 that indicates a control number that is designated by the number 44. In this instance, the number designated is 14036. The significance of this control number will be hereinafter more fully appreciated as the invention is more completely described. Located in close proximity to this block 43 are respective blocks or spaces 46 and 48 for respectively indicating the individual, or the individual's code number, etc., that performed the laboratory tests and the date that the test(s) were performed.

Located below these blocks or portions 43, 46 and 48 are a series of columns and spaces in which the headings for the columns are designated by the respective words or designations X, TESTS, NORMAL and RESULT. These columns are respectively designated by the numbers 50, 52, 54, and 56. The X column 50 is, of course, used to indicate that the test has actually been ordered by inserting an appropriate "X" in the appropriate blank. The TEST column 52 is utilized to indicate the type of test that has been run. The NORMAL column 54 is utilized to indicate the normal values of that test. Of course, the RESULT column designated by the number 56 gives the results of all the tests that have been performed even though the results are normal.

The use of the NORMAL column coupled with the actual RESULT column which are designated respectively with the numbers 54 and 56 is advantageous in a variety of ways. For instance, the medical request/report form set 10, as a result of the column designated by the number 56 permits the physician or the like to monitor the conditions of the tests where it is appropriate even though they may be within what is considered acceptable normal ranges. The importance of this latter ability cannot be overemphasized since it enables the physician supervising the care of the patient to monitor the effectiveness of drugs that have already brought the patient's condition into a state where the laboratory tests indicate normal results. For instance, in the treatment of such common diseases as gout, it is possible that the uric acid level determined from specific tests would be completely within the normal range. However, deviations even within the normal range if they were severe enough, could indicate that the medication should be changed or that the patient might suffer adverse reactions.

It should also be noted that provision is provided on the same portion of this request/report form set 10 for listing events related to the test and the manner in which the tests were administered. This portion is designated by the number 58 and can be utilized to indicate any pertinent comments related to the performance of the test, condition of the specimen, results of the test, etc.

As indicated in FIG. 4, attached to and forming a portion of the request/report form set 10 is another set designated generally by the number 60. This set consists of a backing material 62 and various separable numbered portions designated by the number 64. These portions designated by the number 64 can be stripped from the backing material 62 and they can then be separated along the lines designated by the numbers 66. As a consequence, these portions 64 form tags or the like that contain the numerical designation. The numerical designations of each of these portions 64 is identical to the designations set forth in the block designated previously by the number 44 in FIG. 1. The back portions or the portions that do not contain the designations such as the number indicated in the block 44 contain an adhesive type substance that can be utilized to cause the portion 64 to be readily adhered to tubes or the like that may contain specimens to be taken as a result of the laboratory tests indicated by the laboratory request/report form set 10. This adhesive backing may comprise a pressure type adhesive or some type of adhesive that necessitates the use of water or some aquaeous solution that causes it to be activated and to set.

These pre-numbered separable labeled portions designated by the number 64 can be utilized to identify various specimens such as tubes containing blood and the like so that they are positively identified with the tests that are indicated to be run on the identically numbered laboratory request/report form set 10. The number of these separable portions 64 should be sufficient to enable all of the specimens to be positively labeled with the appropriate number of other identification.

The ability to label all of the specimens that are taken as a result of a specific medical request/report form 10 that has the identical numerical indication 44 in the block 43 minimizes or eliminates the possibilities of errors occurring in the laboratory with the samples and the like that have been taken as a result of the requested tests indicated on the appropriate medical request/report form 10. Of course, in appropriate cases where there were no specimens to be taken or with specimens that were taken which were to be analyzed individually immediately, there would be no necessity for the combination designated by the number 60.

Figure 2:
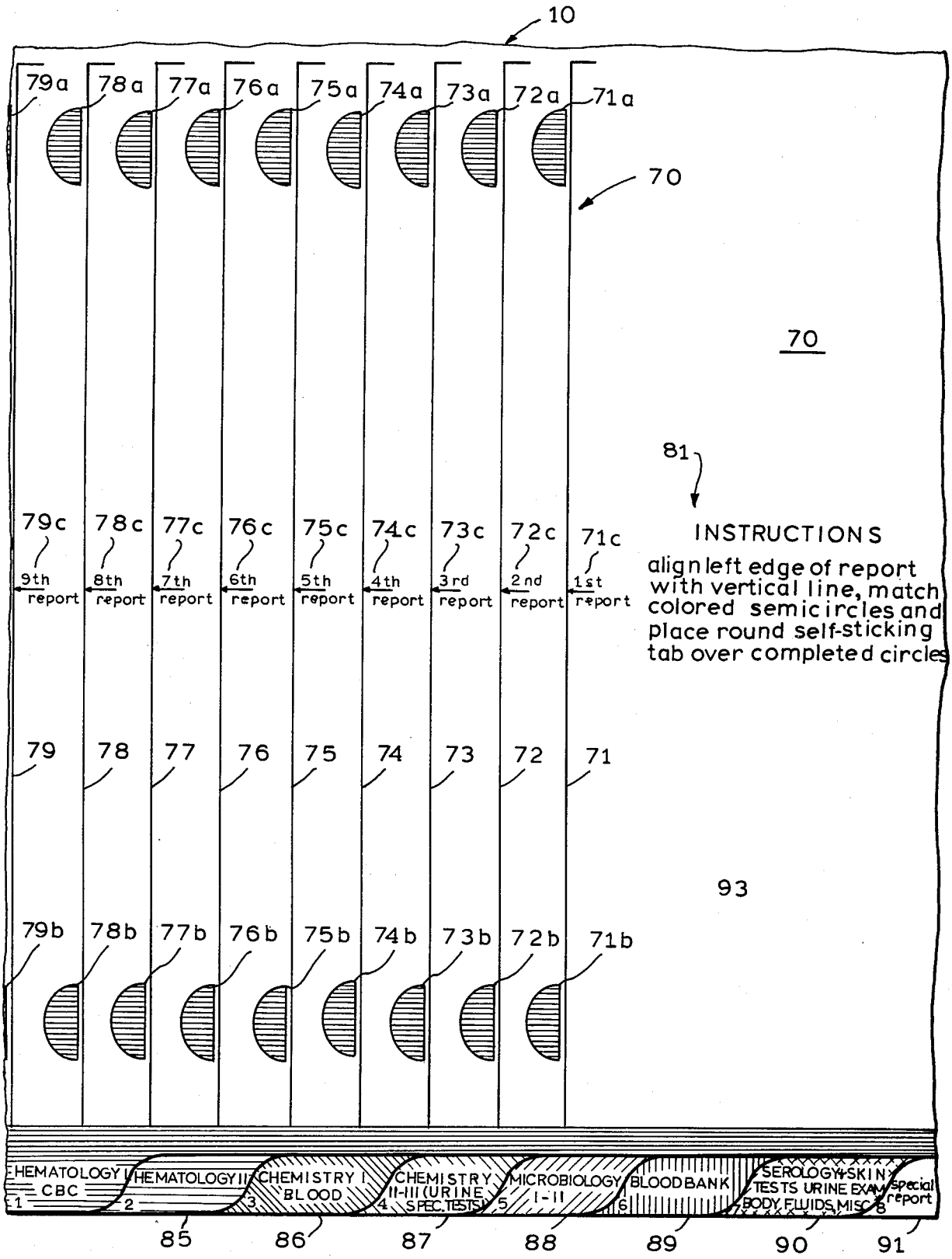
FIG. 2 is a top or plan view of attachment sheets which form part of the present invention.

As best illustrated in FIGS. 1 and 3A, one of the plurality of separate layers designated by the numbers 12, 13, 14 and 15 of the medical request/report form set 10 is designated as the chart copy. In this instance the chart copy is designated by the number 12. This chart copy 12 is adapted to be attached to means for attaching the chart copy which comprises a thin sheet designated by the number 70 that is illustrated in FIG. 2. As illustrated in FIG. 2, the attachment means or sheet 70 has a series of vertical or substantially vertical lines designated by the respective numbers 71, 72, 73, 74, 75, 76, 77, 78 and 79. These respective lines have color coded partial circles imprinted toward the upper and lower portions of the lines which are designated respectively 71*a*, 71*b*, 72*a*, 72*b*, 73*a*, 73*b*, 74*a*, 74*b*, 75*a*, 75*b*, 76*a*, 76*b*, 77*a*, 77*b*, 78*a*, 78*b*, 79*a*, and 79*b*. The spacing of these respective semi-circles is such that they will substantially match the spacing of similar semi-circles designated 80*a* and *b* on the chart copy of the separable layer 12. It will be appreciated that modifications of the semi-circles or different configurations can be gainfully employed. Such modifications could include triangles, rectangles, etc. or a series of the same.

It should be noted that the sheet 70 has instructions designated by the number 81 indicating how the respective chart copies 12 should be aligned or arranged with respect to the sheet 70. Moreover, each of the respective lines 71, 72, 73, 74, 75, 76, 77, 78 and 79 has an indication designated respectively by 71*c*, 72*c*, 73*c*, 74*c*, 75*c*, 76*c*, 77*c*, 78*c* and 79*c* for indicating the chronological sequence of arrangement of the chart copies 12. For instance, the first chart copy report in chronological order should be aligned in accordance with the instructions, with the line numbered 71 and the last one would be aligned with the one numbered 79. Furthermore, these semi-circles on the respective chart copies 12 such as those designated by the numbers 80*a* and *b* should be aligned with the respective semi-circles such as those 71*a* and 71*b* on sheet 70. After this has been accomplished the respective chart copy is attached in the appropriate location on the sheet 70 through the use of matching circular tabs illustrated in FIG. 3B that have a self-sticking under layer of adhesive.

Figure 3B:
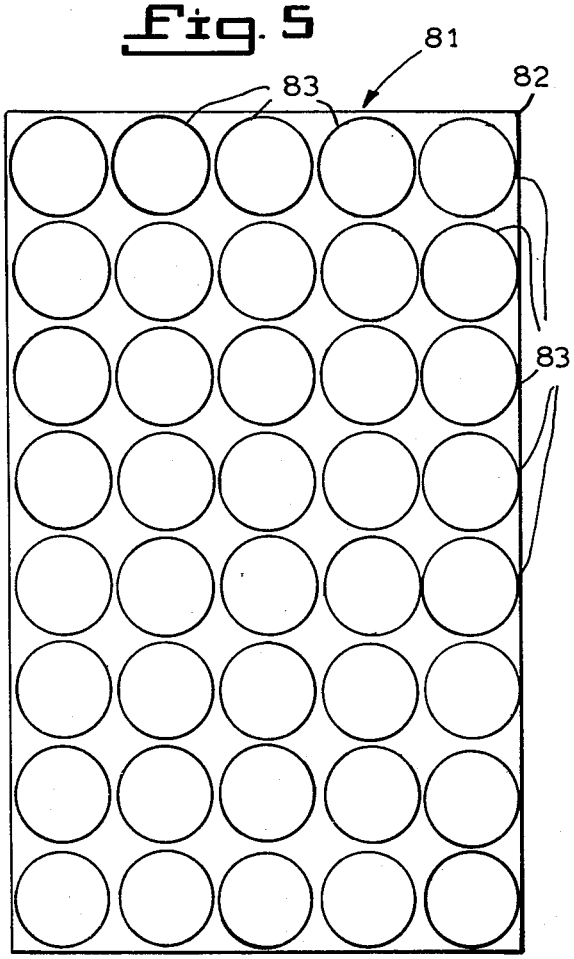
FIG. 3B is a top or plan view of a sheet containing attachment means used in connection with attachment sheets and request/report form sets set forth in FIG. 3A.

FIG. 3B illustrates a sheet and attached circle combination designated generally by the number 81 that comprises a flat sheet member 82 that has numerous circular or substantially circular shaped attaching members 83 that have an adhesive backing that may comprise a pressure type adhesive or some type of adhesive that necessitates the use of water or some aqueous solution that causes it to be activated and to set. As previously indicated, these attaching members 83 are peeled off from the backing sheet member 82 and then their appropriate portions are attached to the semi-circles such as those designated by the numbers 71*a* and 71*b* on the sheet 70. The other appropriate portions of the attaching members 83 are attached to the semi-circles such as those designated by the numbers 80*a* and 80*b* on the chart copy illustrated in FIG. 1.

As this is accomplished for a series of tests that have been run over a period of time as illustrated in FIG. 3A the appropriate test results will be readily visible to the physician by merely viewing the appropriate chart copy 12 that has been sequentially attached to the sheet 70 without the necessity of having the physician review unessential information that is covered up by the succeeding chart copies 12. The performance date block 48 on each of the chart copies is also visible so that the test results can be related to the various dates that the tests were performed. It should also be noted that since the top chart copy 12 has the TEST 52 and NORMAL columns visible, this information is also available for some or all of the previous partially covered chart copies 12.

Thus far the discussion of the utilization of a portion of the medical request/report form set 10 as it was related to the thin attachment sheet designated by the number 70. In this connection, the chart copy of the medical request/report form set is color coded to match the sheet designated by the number 70. For instance, the chart copy 12 in question and the sheet 70 were color coded with the color green to indicate CHEM., BLOOD. However, as indicated in FIG. 2, there are other attachment sheets that are color coded such as sheet 70 and these are designated respectively by the numbers 85, 86, 87, 88, 89 and 90 which are color coded respectively by the color blue to indicate HEMATOLOGY, dark green to indicate CHEMISTRY I BLOOD, light green to indicate CHEMISTRY II-III (Urine and Special Tests, brown to indicate MICROBIOLOGY I-II, red to indicate BLOOD BANK and orange to indicate Seriology Skin Tests, Urine Exam, Blood Fluids, Miscellaneous. Furthermore, a special sheet designated by the number 91 is also provided for a special report which is hereinafter more fully discussed in greater detail.

These respective sheets 85, 86, 87, 88, 89 and 90 have the same type of information that appears on the sheet 70 which is designated as 71, 72, 73, 74, 75, 76, 77, 78, 79 and 71 *a, b,* and *c;* 72 *a, b,* and *c;* 73 *a, b,* and *c;* 74 *a, b,* and *c;* 75 *a, b,* and *c;* 76 *a, b,* and *c;* 77 *a, b,* and *c;* 78 *a, b,* and *c;* and 79 *a, b,* and *c.* However, this respective information or designation or lines are color coded to correspond to the color coding that is appropriate for the respective sheet. However, in other respects these attachment sheets, other than sheet 70, are utilized in the same manner as the sheets 70 and the appropriate request/report form set 10.

Figure 5:
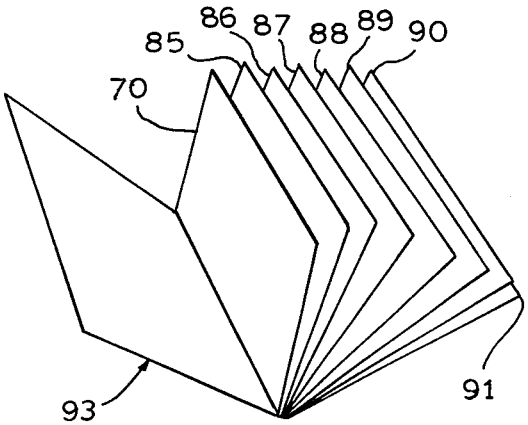
FIG. 5 is a perspective view of a completed record folder chart of the invention.

After a series of these attachment sheets such as the sheets 85, 86, 87, 88, 89 and 90 have had the appropriate portion of the medical request/report form set attached to them in the manner previously indicated with respect to the sheet 70 they are inserted, in a conventional manner, into a hospital medical record chart or folder designated by the number 93 as illustrated in FIG. 5 which illustrates the completed medical chart or folder of the invention. As illustrated in FIG. 5, the physician or the like through the use of the completed chart 93 has ready access to a series of different types of tests that have been run over a period of time that conveniently only indicate the essential information that the physician or the like needs. Furthermore, since the respective attachment sheets are color coded, such as the sheet 70 of FIG. 3A, the physician can readily go to the appropriate color coded sheet that he is interested in and only be concerned with the date associated with the chronological inserted medical request/report data form sets and not be bothered with unessential information as indicated previously with respect to the utilization of the attachment sheet and chart copies designated respectively by the numbers 70 and 12.

Figure 6:
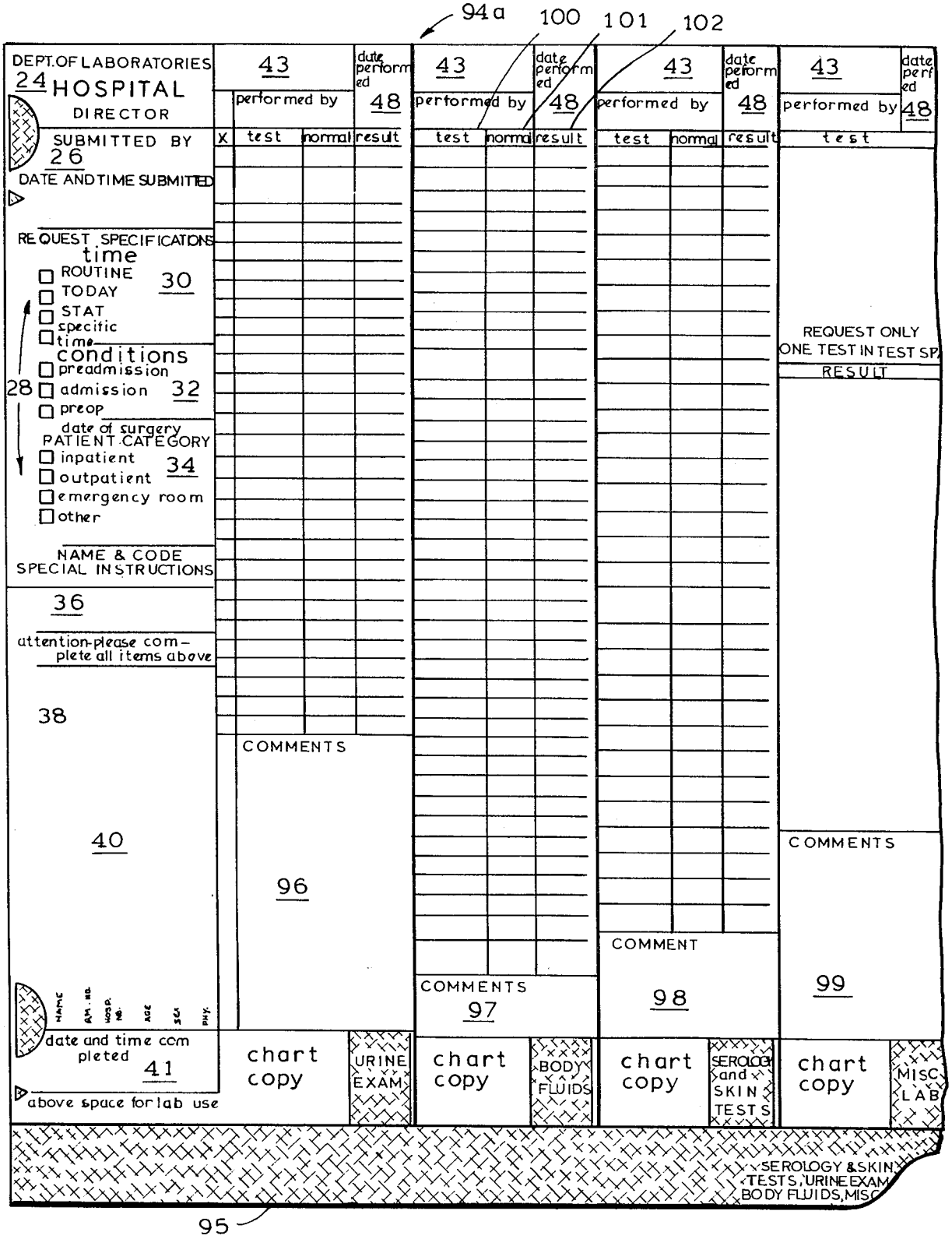
FIG. 6 is a top or plan view of an additional attachment sheet embodiment of the invention illustrating how four different request/report form layers can be attached to one of the attachment sheets.

FIGS. 6, 7, 8 and 9 illustrate additional embodiments of the present invention that are designated generally as 94*a* and 94*b*. FIG. 6 illustrates the additional data that is available to the physician, etc., as a result of this additional embodiment. For instance, in addition to just monitoring routine tests the physician is given the actual tests performed, the normal result of the tests, plus the actual results. Whereas in the previous embodiment the normal result and the data and the test itself were not presented to the physician since he was monitoring the patient over a period of time with respect to a particular test or tests. Moreover, as indicated in FIG. 6, the data presented therein is related to various types of tests such as urine exams, body fluids, serology, etc. The procedures set forth associated with FIG. 6 are similar to those set forth as heretofore described except that the various tests are combined on a single chart copy attachment sheet 95 so the physician has a cross-section of various types of tests that have been done and the results thereof on a patient readily available to him. The description and the procedures associated with the previous embodiment are essentially the same and hence are not described in detail. However, in this instance the physician or the like has the ability to, for instance, monitor the urinary function on the URINE EXAM chart copy designated by the number 96, the BODY FLUIDS chart copy designated by the number 97, the SEROLOGY AND SKIN TESTS chart copy designated by the number 98 and the MISC. LAB tests chart copy designated by the number 99. In each instance repetitious information such as that set forth related to the previous embodiment such as that related to the patient's name, time of test, conditions of test, patient's category, etc. are only set forth in a manner that such information is only visible on the top or upper chart copy so that the physician or the like need only review one form such as that designated generally by the form 96 for such information.

As indicated in FIG. 6, each chart copy such as the chart copy designated by the number 97 even though the chart copy, such as the copy designated by the number 97, is partially covered up it still displays the TEST, NORMAL and RESULT columns designated by the numbers 100, 101, and 102. Whereas in the previous embodiment, as illustrated in FIG. 3A, the partially covered up chart copies only displayed the RESULT column. The additional information indicated above with respect to the columns TEST and NORMAL with respect to the chart copy 97 is necessary since the various chart copies 96, 97, 98 and 99 for various tests are attached to the single chart copy attachment sheet 95.

Figure 7:
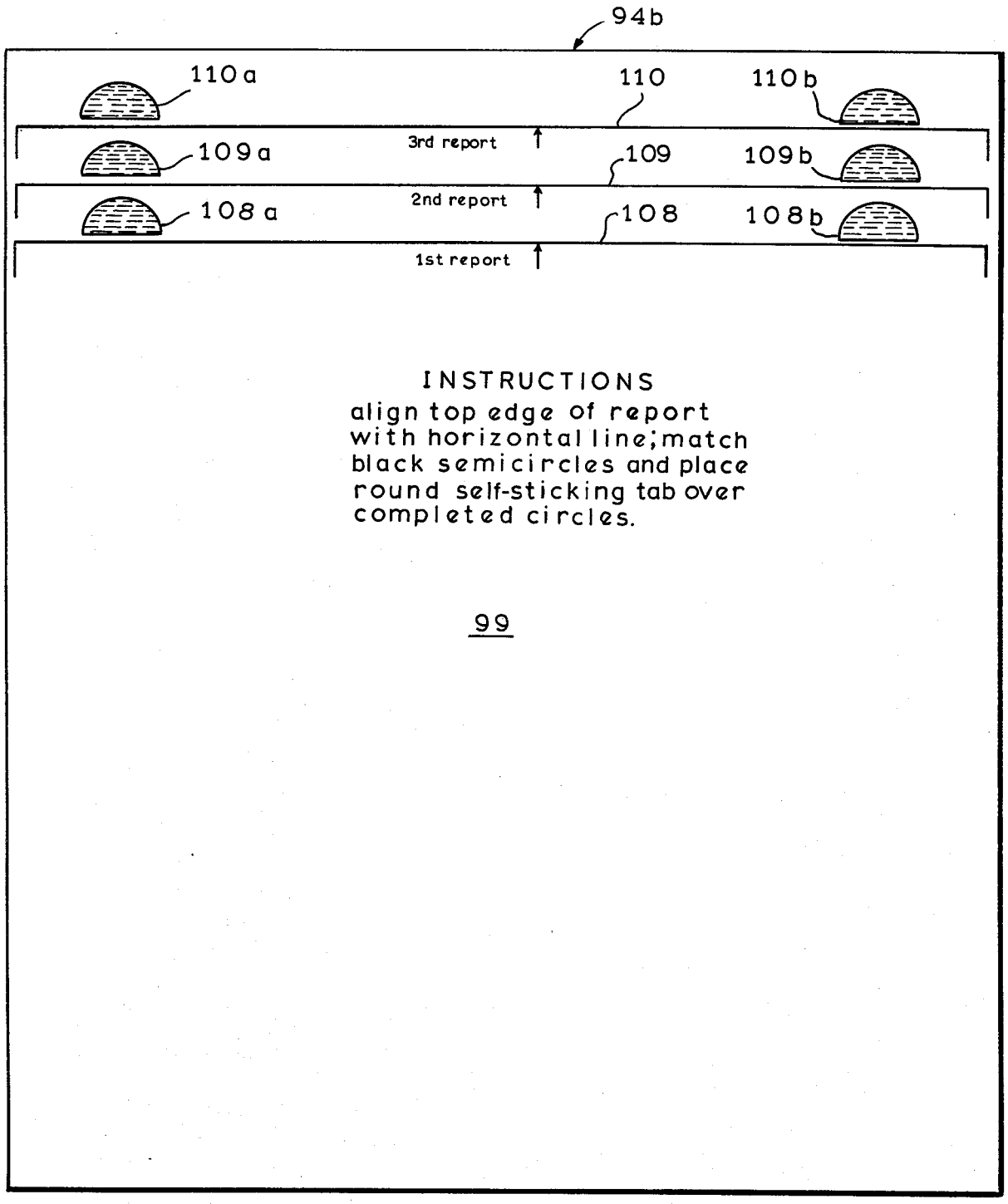
FIG. 7 is a top or plan view of a different attachment sheet embodiment that is adapted for use in connection with special request/report forms.
Figure 8:
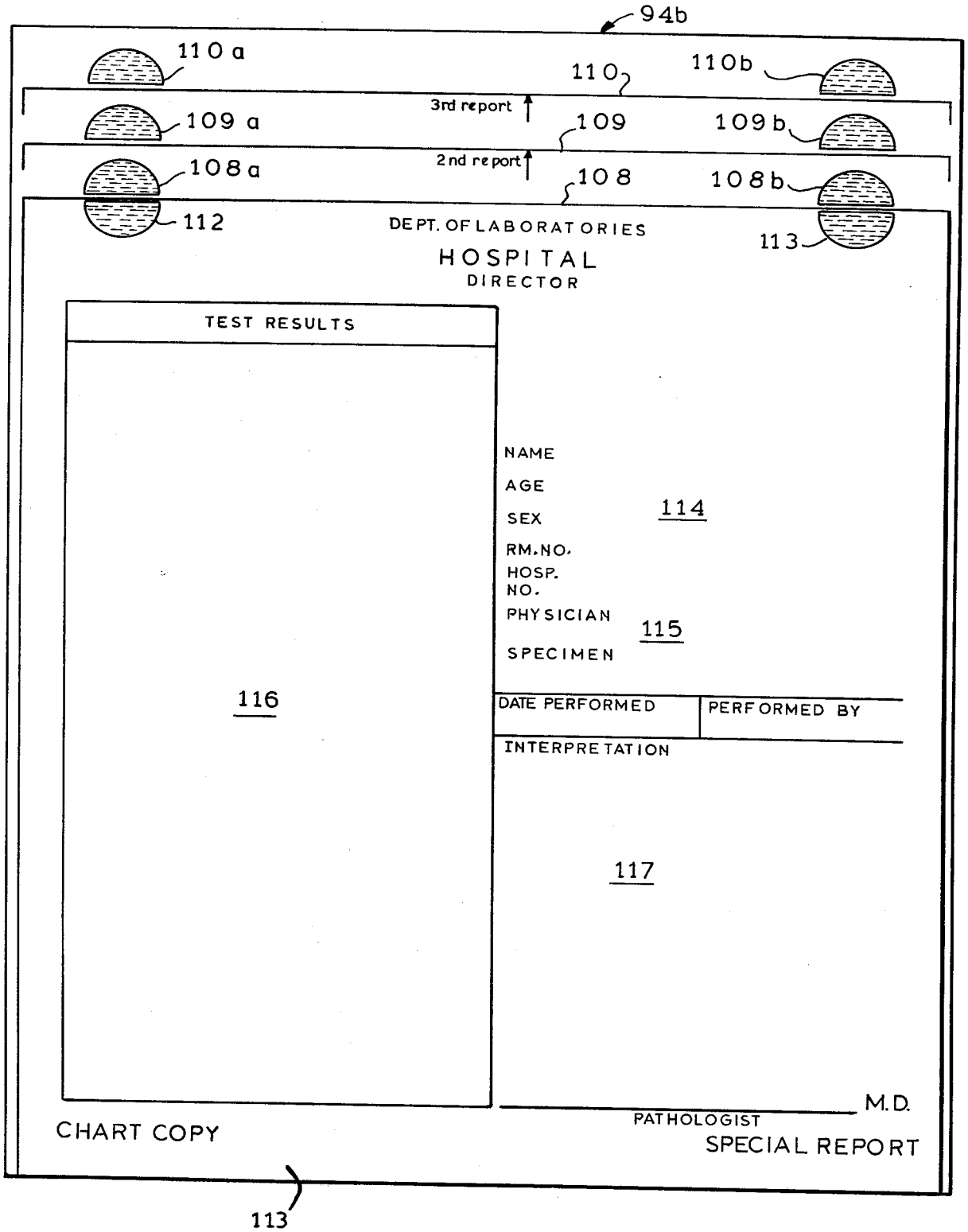
FIG. 8 is a top or plan view of the attachment sheet illustrated in FIG. 7 illustrating how the special report forms are attached to the attachment sheet.

FIGS. 7 and 8 illustrate the embodiment of the invention designated as 94*b* which comprises a chart copy attachment sheet 99. This chart copy attachment sheet 99 has respective substantially horizontal color coded lines designated by the respective numbers 108, 109 and 110. These color coded lines have color coded partial circles of the same color, designated 108*a*, 108*b*, 109*a*, 109*b*, 110*a* and 110*b*, located near the respective upper left and right portions of these lines. The spacing of these respective semi-circles is such that they will substantially match the spacing of similar color coded semi-circles designated respectively by the numbers 112 and 113 on the special report chart copy 114 illustrated in FIG. 8.

As indicated in FIG. 8, the chart copy 113 has a space 114 for filling in data related to the patient's name, etc. and another space 115 for the physician's name and specimen designation. The chart copy 113 also has a space 116 for test results and another space 117 for indicating the interpretation of the test results. The chart copies of the embodiments designated as 94*a* illustrated in FIG. 6 and the embodiment designated as 94*b* illustrated in FIGS. 7 and 8 are attached to the respective chart copy attachment sheets 95 and 99 using the adhesive backed stickers 83 illustrated in FIG. 3B in a manner similar to that related to the embodiment set forth in FIG. 3A.

Figure 9:
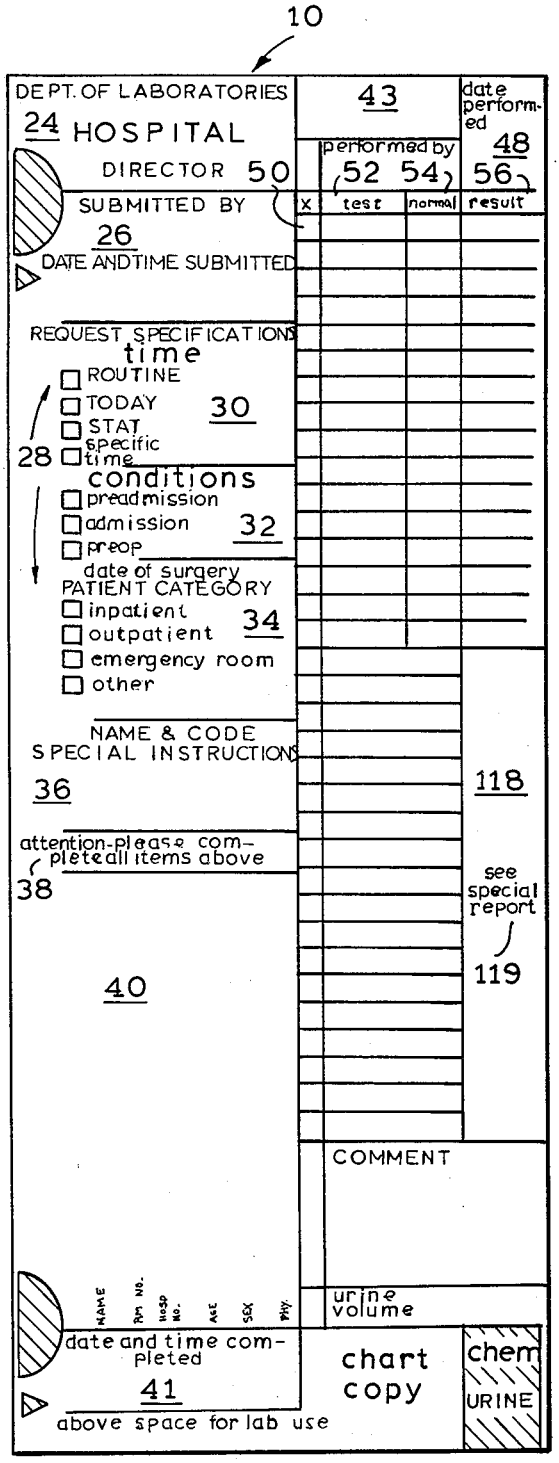
FIG. 9 is a front elevational view of the multilayered request/report form set that is adapted for use in connection with the special report attachment sheet and special report forms illustrated in FIGS. 7 and 8.

FIG. 9 illustrates a chart copy 118 that contains the same information and is substantially the same as the chart copy 12 illustrated in FIG. 1. However, this chart copy 118 has a portion 119 that refers to the special report emodiment 94*b* set forth in FIGS. 7 and 8 so that the person using the chart copy 118 is alerted to the fact that further test information is available on the special report 94*b*.

The invention is utilized in the following manner. The physician or person requesting the laboratory request(s) fills out the laboratory request/report form set 10 illustrated in FIG. 1 through the use of a ball point pen or the like and in view of the fact that the layers designated by the numbers 12, 13, 14 and 15 all receive the same data, the physician or other person filling out the form need not fill out a plurality of forms but instead can indicate the necessary information on the first sheet which is designated by the number 12.

After the request/report form set such as that designated by the number 10 has been completed it is sent to the laboratory where subsequently the separable portions thereof are separated and they are sent to the various departments or the like that may need to utilize the information contained on the request/report form set 10. For instance, one portion thereof may go to accounting, the other portion thereof may be retained by the laboratory as their record of the test results, another portion may go to the physician, etc. However, the front portion which is designated as the chart copy 12 will normally go to the patient's chart.

If specimens must be taken related to the tests involved, then the attachment designated by the number 60 illustrated in FIG. 4 is utilized and the appropriate separable numbered portions designated by the number 64 are separated from the backing material 62 so that the indicated number can be attached to the appropriate specimen bottles, etc. that are utilized in conducting the tests. After the appropriate tests have been conducted and the results have been ascertained, the physician or the like is provided with the chart copy such as that illustrated in FIG. 1 and which is designated by the number 12.

The physician's nurse or appropriate assistant would then take this chart copy 12 and in the manner previously described attach it to the sheet designated by the number 70 that is illustrated in FIG. 2. As indicated previously, the other separable portions of the medical request/report form set would be sent to other appropriate departments in the hospital or other facility. When a number of different chronological chart copies 12 have been attached as previously indicated to the means for attaching the chart copy comprising the thin sheet designated by the number 70 this gives the physician or other medical technician the ability to readily ascertain the results of a series of tests that have been run over a period of time without the need for the person to thoroughly examine irrelevant information that may be contained in each individual chart copy 12.

As illustrated in FIG. 5, the attachment sheet 70 along with other attachment sheets such as those designated by the numbers 85, 86, 87, 88, 89 and 90 are inserted into the medical chart or record folder 93. The attachment sheet, such as the sheet 70, are inserted into the medical record chart or record folder 93 in a conventional manner that is well known in the art.

The embodiment of the invention illustrated in FIG. 6 is utilized in the manner similar to that previously set forth with respect to the previously described embodiment illustrated in FIGS. 1 through 5. However, as previously indicated as as indicated in FIG. 6, certain additional information is available from the chart copies such as those designated by the numbers 97, 98, and 99 when they are attached to the chart attachment sheet 95.

The embodiment of the invention illustrated in FIGS. 7 and 8 is utilized in a manner similar to the embodiments illustrated in FIGS. 1 through 6. However, the various chart copies for the special reports, such as the copy 113, are arranged to have their upper edge portion attached to the chart attachment sheet 99 in a substantially horizontal direction. In addition, the attachment sheet 99 for special reports may also be attached in a conventional manner to the medical chart or record folder 93 as illustrated in FIG. 5. As previously indicated with respect to FIG. 9, a chart copy such as that designated by the number 118 can have a portion thereof, such as that designated by the number 119, so that the person using the chart copy 118 is aware that further test information is available on the special report **94*b*. With this indication that person can then refer to the appropriate special report chart copies such as that designated by the number 113 in FIG. 8**.

It will, of course, be appreciated that the attaching members 83 illustrated in FIG. 3B need not be substantially circular shaped and that they may take any of a variety of shapes.

Although the invention has been described in considerable detail with reference to certain preferred embodiments, it will be understood that variations or modifications may be made within the spirit and scope of the invention as defined in the appended claims.

What is claimed is:

1. A medical history record filing system comprising:

a plurality of medical record sets, each of said medical record sets comprising a plurality of separable portions with at least one of the separable portions having color coded means for indicating the type of medical test to be performed and recorded, said color coded portions of different medical record sets being color coded with different colors for different types of medical tests, the separable portions of said plurality of said medical record sets being divided to form one portion with provisions for indicating the type of tests and another portion with the provisions for reporting on the results of the tests;

a plurality of means for holding medical test records, said plurality of means for holding medical test records having color coded means corresponding to the various colors of the color coded separable portions, said plurality of means for holding medical test records having means for locating a plurality of same color coded portions of said medical test sets to cover up non-essential information, at least some of said plurality of means for holding medical test records having means for arranging a plurality of same color coded portions of said medical record sets in chronological sequence;

attachment means for attaching the color coded separable portions of said medical record sets to said plurality of means for holding medical test records; and detachable specimen labeling means associated with at least one of said medical record sets.

2. The medical history record filing system of claim 1 wherein said detachable labeling means comprise separable tag portions having a numerical designation and wherein at least one of the separable portions of said medical record sets has a numerical designation, the numerical designations on the separable tag portions being identical to the numerical designation on the separable portion of said medical record set.

3. The medical history record filing system of claim 2 wherein the separable tag portions are located on a backing material and are stripable therefrom.

4. The medical history record filing system of claim 2 wherein said means for arranging a plurality of same color coded portions of said medical record sets in chronological order comprises a series of substantially parallel lines.

5. The medical history record filing system of claim 4 further comprising at least one substantially one-half portion of a geometrical figure located adjacent to each of said lines.

6. The medical history record filing system of claim 5 wherein at least two spaced substantially one-half portions of a geometrical figure are located adjacent to each of said lines.

7. The medical history record filing system of claim 6 wherein at least two matching substantially one-half portions of a geometrical figure are located adjacent to an edge of a plurality of separable portions of said medical record sets and wherein said substantially one-half portions of a geometrical figure are color coded with the same color.

8. The medical history record filing system of claim 7 wherein said attachment means for attaching the color coded separable portions of said medical record sets comprises tabs having a matching substantially full geometrical figure adapted to be placed over the substantially one-half of a portion of a geometrical figure on the color coded separable portions and the substantially one-half of a portion of a geometrical figure located adjacent to the lines.

9. The medical history record filing system of claim 8 wherein said one-half portion of a geometrical figure comprises a semi-circle.

10. The medical history record filing system of claim 8 wherein the separable portion of said medical record sets have respective columns to indicate the type of test run, the normal values of the test, the results of the tests and the date of the tests and wherein said means for locating a plurality of same color coded portions of said medical record sets to cover up non-essential information comprises means for covering up columns indicating the type of test run and the normal values of the test.

11. The medical history record filing system of claim 10 further comprising at least one additional means for holding medical test records for holding separable portions of a special medical record set and wherein at least one of the separable portions of said non-special medical record sets has a reference to the special medical report.

12. The medical history record filing system of claim 11 wherein at least one of the separable portions of said medical record sets has means fo indicating the urgency of the desired test.

* * * * *